US005513811A

United States Patent [19]

Phan Hung

[11] Patent Number: 5,513,811

[45] Date of Patent: May 7, 1996

[54] IMPACTOR WITH A PIVOTABLE GRINDING FACE

[75] Inventor: Hiep Phan Hung, Muenster, Germany

[73] Assignee: Noell Service und Maschinentechnik GmbH, Langenhagen, Germany

[21] Appl. No.: 352,559

[22] Filed: Dec. 8, 1994

[30] Foreign Application Priority Data

Dec. 18, 1993 [DE] Germany ..... 43 43 406.1

[51] Int. Cl.[6] ..... B02C 13/06; B02C 13/26

[52] U.S. Cl. ..... 241/189.1; 241/285.2; 241/285.3

[58] Field of Search ..... 241/189.1, 285.2, 241/285.3, 239, 241

[56] References Cited

U.S. PATENT DOCUMENTS

| | | | |
|---|---|---|---|
| 3,480,214 | 11/1969 | Wageneder | 241/285.3 X |
| 3,531,055 | 9/1970 | Alt | 241/285.3 X |
| 3,659,794 | 5/1972 | Hemesath | 241/189.1 |
| 3,813,045 | 5/1974 | Greiffenstern | 241/88.4 |
| 3,857,519 | 12/1974 | Schafer et al. | 241/239 X |
| 4,049,206 | 9/1977 | Konig et al. | 241/73 |
| 5,213,273 | 5/1993 | Linnerz | 241/73 |
| 5,435,050 | 7/1995 | Alt | 241/285.3 X |
| 5,443,568 | 8/1995 | Popovich | 241/189.1 |

FOREIGN PATENT DOCUMENTS

| | | | |
|---|---|---|---|
| 1764034 | 3/1958 | Germany . | |
| 1934545 | 11/1978 | Germany . | |
| 1607455 | 6/1979 | Germany | 241/285.2 |
| 3030913 | 3/1985 | Germany . | |
| 2516014 | 5/1986 | Germany . | |

*Primary Examiner*—John Husar
*Attorney, Agent, or Firm*—Michael J. Striker

[57] ABSTRACT

The impactor includes a grinding face 4 disposed underneath the impact aprons 3 at the side of the housing 1 opposite the feed material inlet, the grinding face partially extending under the rotor 2 and connected with a hinged rear housing wall 5 so that it executes a movement away from the rotor when the rear housing wall swings outwards. According to the invention, the grinding face 4 movably rests on a base member 15, a rail or plate, attached to the housing 1, and the lower part of the grinding face 4 is pivotally connected to the rear housing wall 5 by a first linking element 11 at a pivot point 18 located above the pivot element 6 of the rear housing wall 5, and the upper part of the grinding face 4 is pivotably connected to the rear housing wall 5 by a second linking element 12 at a pivot point 19 located a greater distance away from the pivot element 6 than pivot point 18.

8 Claims, 2 Drawing Sheets

IMPACTOR WITH A PIVOTABLE GRINDING FACE

BACKGROUND OF THE INVENTION

The present invention relates to an impactor having grinding face arranged underneath the impact aprons at the side of the housing opposite to the feed material inlet, the grinding face extending at least partially under the rotor. Because of the close proximity of the grinding face to the rotor, which makes impossible the examination/replacement of its crushing implements in the operating position, the grinding face has been arranged so that it can be moved into a position away from the rotor. To do this, the grinding face of a known impactor described in German Patent DE-PS 19 34 545 has been arranged on a track, on which it can be retracted from the housing along with a section of the housing rear wall. Also, it has been tiltably arranged on a track in the known impactor described in German Published Patent Application DE-OS 30 30 913, so that it can be moved into a more or less horizontal position outside the housing, to facilitate replacement of worn parts, for example. Such designs require rails extending well beyond the impactor housing for the retraction of the grinding face, as well as correspondingly large adjusting cylinders and floor space.

In the case of another known impactor of the type described in German Patent DE-PS 25 16 014, the impact aprons and the grinding face are mounted on the outwardly swingable rear wall of the housing by axles provided at their lower ends and the grinding face is connected to the rear wall so that, when the rear wall swings outwards, the grinding face moves away from the rotor, executing a pivoting motion into a flatter position. The upper part of the grinding face is pivotably connected to the hinged rear wall of the housing, Whereas the lower part is connected via a linking means to the static section of the housing. When the rear wall swings outwards, the grinding face moves away from the rotor with an inclined upward motion, at the same time executing a slight outward movement, so that access to worn parts becomes easier for replacement purposes. However, in the case of impactors with grinding faces which extend underneath the rotor to a greater extent, this arrangement cannot be employed, since the bottom of the grinding path could enter the circle described by the rotor tips when the housing rear wall is opened.

SUMMARY OF THE INVENTION

It is an object of the present invention to provide an impactor of the above-described type in which, when the hinged housing rear wall swings outwards, a grinding face movement with a greater horizontal component and a bigger pivot is attained, so that the grinding face cannot collide with the rotor and assumes a flatter end position, thus greatly facilitating the replacement of worn parts in comparison to known impactors.

Moreover, it is also an object of the invention to provide an impactor of the above described type in which the grinding face assumes a horizontal end position which is well below the level of the rotor center axis, and so can be used by operating personnel to stand on when changing the blow bars of the rotor and the impact plates of the impact aprons.

The impactor according to the invention comprises a housing including a pivotally mounted rear housing wall and provided with a material feed inlet; a rotor rotatably mounted in the housing about a rotor axis; impact aprons and a grinding face positioned adjacent the rotor, the grinding face being arranged underneath the impact aprons on a side of the housing opposite to the material feed inlet and at least partially extending underneath the rotor; a base member, advantageously a rail or plate, in the housing and to which the grinding face is movably connected and rests movably thereon; means for pivoting the rear housing wall outwardly on a pivot element at a lower end thereof; a first linking means for pivotally connecting the grinding face to the rear housing wall, the first linking means being pivotally connected to the rear housing wall at a pivot point on the rear housing wall located above the pivot element and a second linking means for pivotally connecting the grinding face to the rear housing wall. The second linking means, also advantageously a bar or the like, is pivotally connected to the rear housing wall at a pivot point on the rear housing wall positioned further from the pivot element than the pivot point for the first linking means, so that, as a result of a pivoting movement of the rear housing wall from a closed position to an open position, the grinding face pivots away from the rotor and into a more nearly horizontal position.

The essential difference compared with the known impactor is that the grinding face is pivotally connected to the hinged rear housing wall in its top or upper part as well as in its bottom part, in both cases by linking means which are pivotable at both of their ends. The difference in spacing between their pivot points on the rear housing rear wall and the pivot element or axis of the rear housing wall produces differingly large movements of the upper and lower parts of the grinding face, thus imparting a turning or pivoting motion to the grinding face as the rear housing wall is pivoted open.

In a preferred embodiment of the invention this intended grinding face movement proceeds somewhat flatter at first if the pivot points of the first and second linking means on the grinding face are spaced further apart than the pivot points of the linking means on the hinged rear housing wall, and the upper second link means is more or less horizontal when the rear housing wall is in the closed position. As a result, there is a reduced probability of a collision between the grinding face and the rotor during the opening of the rear housing wall. Nevertheless, when the rear wall is in the fully open position, the grinding face assumes a suitably flat or horizontal position to allow maintenance work to be carried out on it and the other parts of the impactor.

As a preferred embodiment of the invention, the linking means connecting the lower part of the grinding face to the housing rear wall can be designed as an adjusting rod, the length of which can be varied by a hydraulic piston-cylinder unit, to adjust the crushing gap between grinding face and the circle described by the rotor tips. The advantage is that the greater distance between the pivot points of the linking means on the grinding face also provides the hydraulic piston-cylinder unit with better leverage for adjustment of the grinding face.

The upper linking means can also be designed so that it can be varied in length for adjusting the gap between the upper part of the grinding face and the rotor tip circle. However, as this adjustment is seldom needed, an actuation means by spindle and nut is sufficient. An independent method of adjustment of the lower and upper parts of a grinding face operating together with an impactor rotor is, in fact, already known from German Published Patent Application DE-GM 1 764 034.

Due to the completely free pivotability of the linking means, the position of the grinding face is not determined by the linking means alone. Hence, fitted to the static part of the housing is a more or less horizontal rail or plate, on which the grinding face movably rests and which absorbs the forces of the feed material acting on the grinding face. By providing a flexible rail or plate mounting, the grinding face can retract under excessive load. It is also possible to mount the rail or plate using a system with a pre-set breaking point, so that it can swing downwards around a pivot axis under excessively high loads. The grinding face can then retract downwards, suspended on both linking means.

It goes without saying that a plurality of linking means and rails can be provided according to the width of the impactor and the corresponding width of the impact aprons and grinding face.

BRIEF DESCRIPTION OF THE DRAWING

The objects, features and advantages of the present invention will now be illustrated in more detail by the following detailed description, reference being made to the accompanying drawing in which.

DESCRIPTION OF THE PREFERRED EMBODIMENTS

Figure 1:
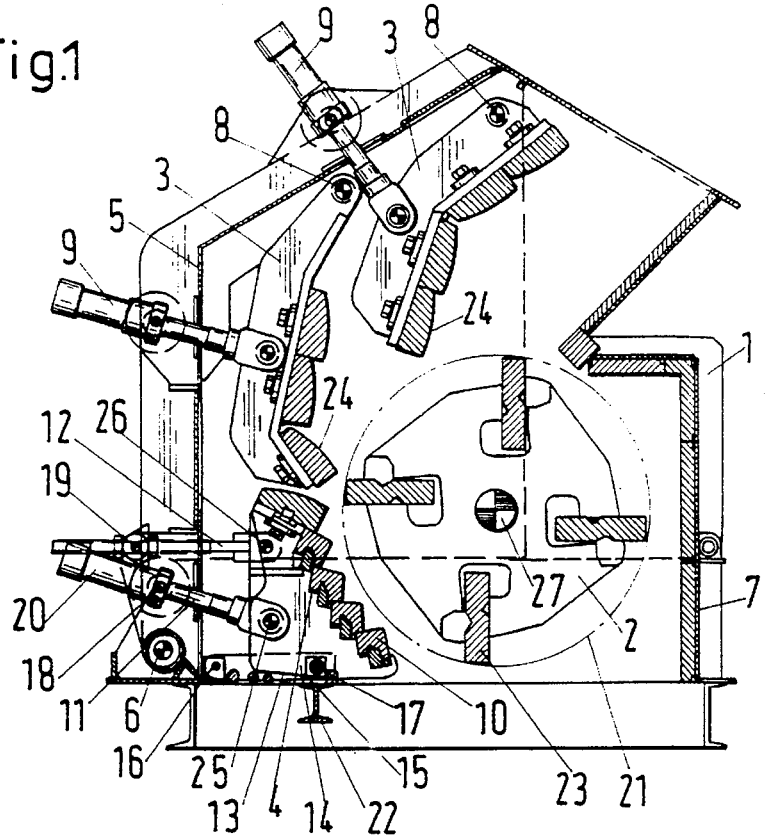
FIG. 1 is a cross-sectional view of an impactor according to the invention in the closed state.

The essential parts of the impactor are the housing 1, the rotor 2 mounted therein, impact aprons 3 and a grinding face 4. The hinged rear wall 5 of the housing 1 is pivotably connected at its lower end to the pivot mount or element 6 in the stationary lower part 7 of the housing 1. Actuation is effected by hydraulic piston-cylinder units 28 provided on both sides of the housing 1 (see FIG. 2).

The impact aprons 3 are pivotably mounted on pivot axles 8 mounted on the rear housing wall 5, and can be adjusted vis a vis the rotor 2 by hydraulically-controlled linking means 9 for pivotally connecting the rear housing wall 5 with the respective impact apron 3.

Figure 4:
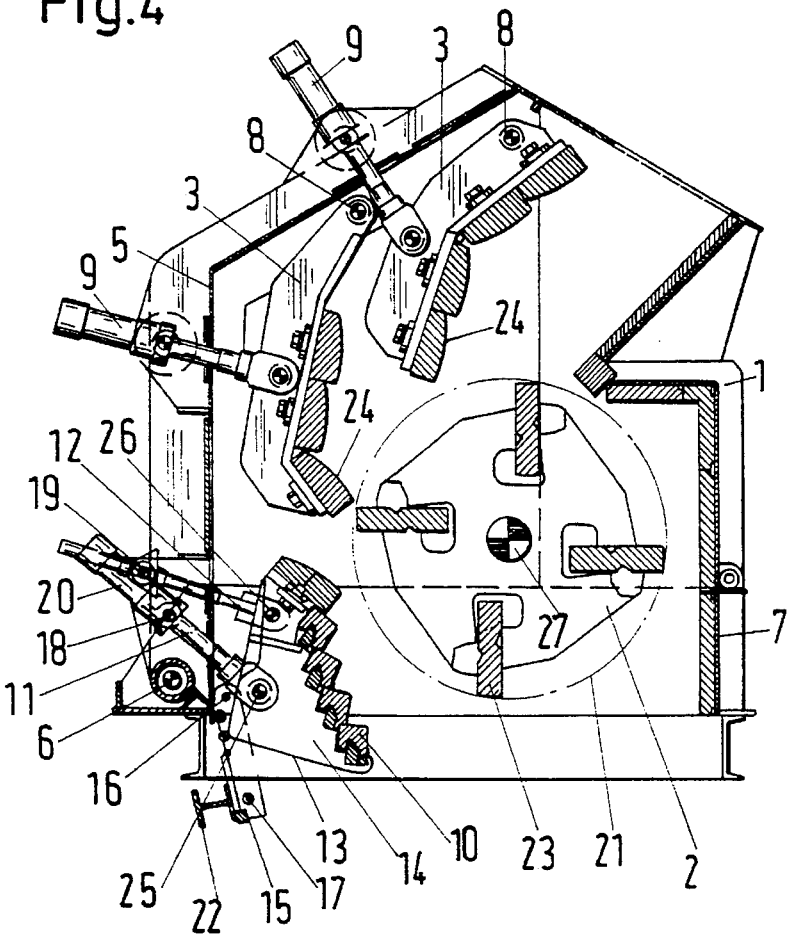
FIG. 4 is a cross-sectional view of the impactor of FIG. 1 in the closed state with the grinding face retracted downwards following excessive loading.

The grinding face 4 is provided with grinding elements 10, and is pivotally connected by two linking means or pairs of linking means 11 and 12 for pivotally connecting it to the rear wall 5. The linking means 11 and 12 are such that the lower edges 13 of the rear reinforcing ribs 14 of the grinding face 4 rest on a plate 15. This plate 15 is pivotably mounted at its rear end, or end furthest from the rotor, on a pivot axle 16 in housing section 7, and is flexibly mounted at its front end. To prevent damage resulting from unacceptably high loads on the grinding face 4, the front mounting can also be provided with a system with a pre-set breaking point 17, so that it can swing downwards together with plate 15 around pivot axle 16, allowing, for example, uncrushables in the feed material to exit from the impactor (see FIG. 4).

The grinding face 4 is pivotally connected to the rear housing wall 5 at its lower end by linking means for pivotally connecting or a pair of linking means 11 and at its upper end by linking means or pairs of linking means 12, whereby the pivot point 18 of the lower linking means 11 is nearer to the pivot element 6 of the rear housing wall 5 than the pivot point 19 of the upper linking means 12. The distance between pivot points 25, 26 of linking means 11, 12 on the grinding face 4 is advantageously greater than the distance between pivot points 18, 19 on the rear housing wall 5, so that the linking means 12 is in a more or less horizontal position when the impactor housing is closed. The lower linking means 11 is provided with a hydraulic piston-cylinder unit 20, by which its length can be varied for the purpose of adjusting the gap between grinding face and rotor tip circle 21 described by the tips of the rotating rotor 2. During this operation, the lower edges 13 of the stiffening ribs 14 of grinding face 4 move on the plate 15, resulting in a small pivoting movement of the grinding face. To ensure that the grinding face always rests well on the plate 15, the lower edges 13 are slightly convex. The plate 15 is stiffened by a doubletee cross beam 22.

Figure 2:
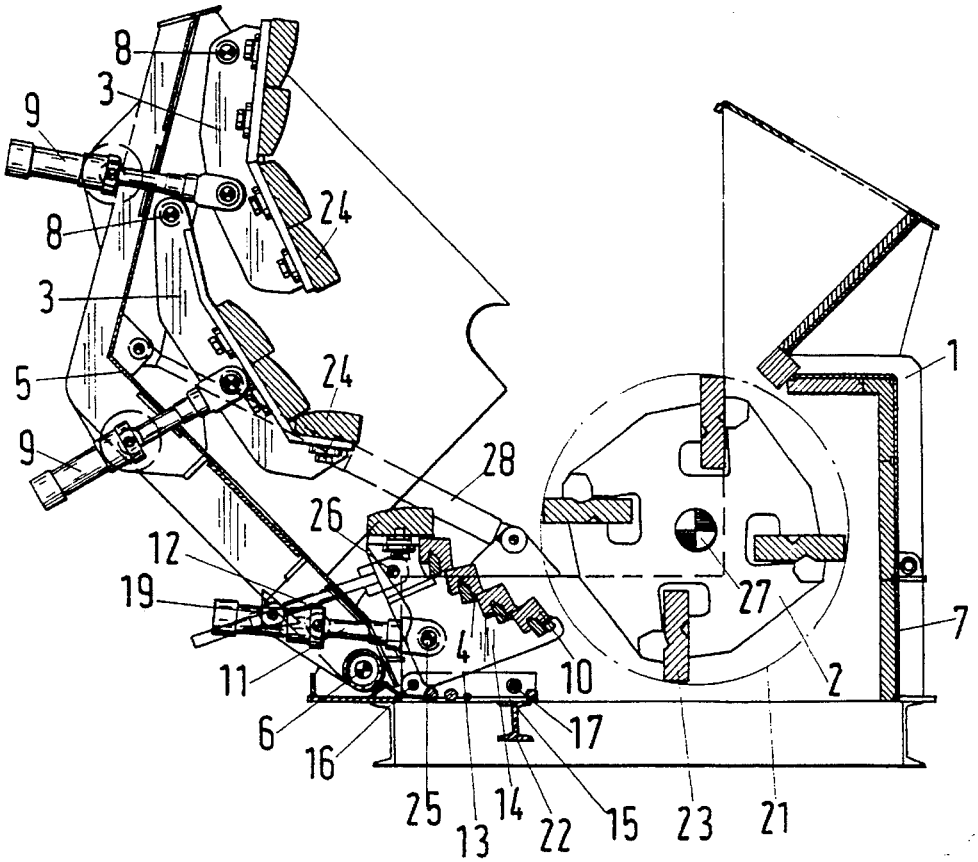
FIG. 2 is a cross-sectional view of the impactor of FIG. 1 with opened hinged housing rear wall.
Figure 3:
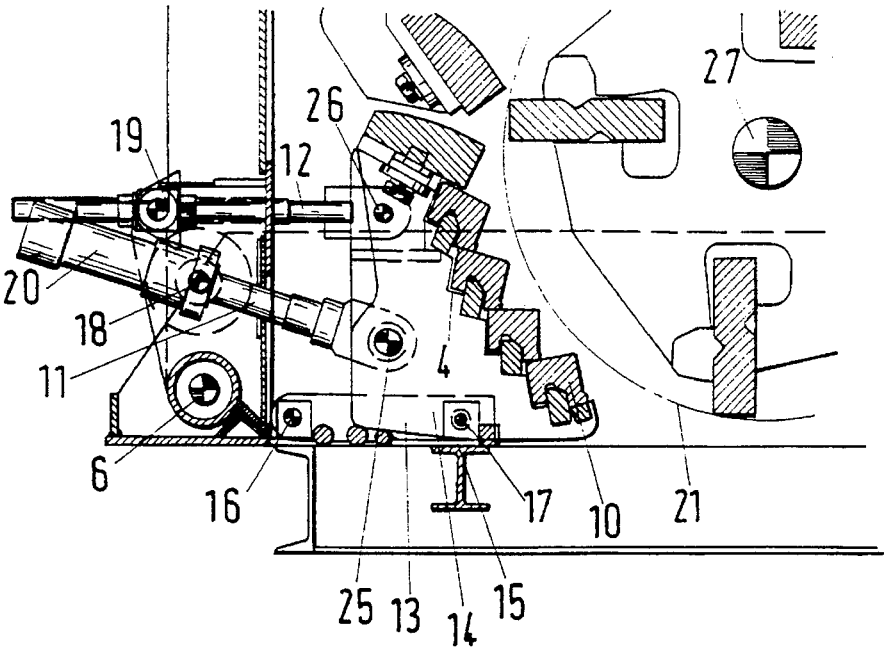
FIG. 3 is a detailed cutaway cross-sectional view of the impactor of FIG. 1.

As shown in FIG. 2, when the rear wall 5 is opened, the grinding face 4 effects a longitudinal movement away from the rotor 2 and, at the same time, an outward pivoting movement (counterclockwise in FIG. 2), so that its worn grinding elements 10 are accessible from above, and are also suitable for operating personnel to stand on during changing of the blow bars 23 of the rotor 2 and impact plates 24 of impact aprons 3.

While the invention has been illustrated and described as embodied in an impactor with a pivotable grinding face, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

I claim:

1. An impactor comprising a housing (1) including a pivotally mounted rear housing wall (5) and provided with a material feed inlet; a rotor (2) rotatably mounted in the housing (1) about a rotor axis (27); impact aprons (3) and a grinding face (4) positioned adjacent the rotor (2), the grinding face (4) being arranged underneath the impact aprons (3) on a side of the housing (1) opposite to the material feed inlet and at least partially extending underneath the rotor (2); a base member (15) mounted in the housing and to which the grinding face (4) is movably connected; means for pivoting said rear housing wall (5) outwardly on a pivot element (6) at a lower end of the rear housing wall (5); a first linking means (11) for pivotally connecting the grinding face (4) to the rear housing wall (5), said first linking means being pivotally connected to the rear housing wall (5) at a pivot point (18) on the rear housing wall (5) located above said pivot element (6) and a second linking means (12) for pivotally connecting the grinding face (4) to the rear housing wall (5), said second linking means (12) being pivotally connected to the rear housing wall (5) at a pivot point (19) on the rear housing wall (5) positioned further from the pivot axis (6) than the pivot point (18) for the first linking means (11), so that, as a result of a pivoting movement of the rear housing wall (5) from a closed position to an open position, the grinding face (4) pivots away from the rotor (2) and into a more nearly horizontal position.

2. An impactor according to claim 1, wherein the first linking means (11) is pivotally connected to the grinding face (4) at a pivot point (25) and the second linking means is pivotally connected to the grinding face (4) at a pivot point (26) and the pivot points (25, 26) of the linking means (11, 12) on the grinding face (4) are spaced further from each other than the pivot points (18, 19) of the linking means on the rear housing wall (5), and the second linking means (12) is in a substantially horizontal orientation when the rear housing wall (5) is in the closed position.

3. An impactor according to claim 2, wherein said second linking means (12) has a predetermined fixed length and said pivot points (18,19; 25,26) are positioned so that said grinding face (4) with said grinding elements (6) is withdrawn from said rotor (2) and attains a substantially horizontal orientation substantially below said rotor axis (21) when said rear housing wall (5) is pivoted from said closed to said open position.

4. An impactor according to claim 1, wherein the first linking means (11) is a rod having a length and means for adjusting said length of said rod, said means for adjusting said length including a hydraulic piston-cylinder unit (20).

5. An impactor according to claim 1, wherein the base member (15) has pre-set breaking elements (17) so that said base member (15) can pivot downward after rupture of the pre-set breaking elements (17).

6. An impactor according to claim 1, wherein a rear surface of the grinding face (4) is provided with at least two ribs (14) extending transversely to the rotor axis (27), said ribs (14) having slightly convex lower edges (13) resting on the base member (15).

7. An impactor according to claim 1, wherein said base member (15) is a rail.

8. An impactor according to claim 1, wherein said base member (15) is a plate.

* * * * *